US007530170B2

(12) United States Patent
Shackelford

(10) Patent No.: US 7,530,170 B2
(45) Date of Patent: May 12, 2009

(54) TOENAIL CLIPPER

(76) Inventor: Richard A. Shackelford, 8404 Cleveland-Massillon Rd., Clinton, OH (US) 44216

( * ) Notice: Subject to any disclaimer, the term of this patent is extended or adjusted under 35 U.S.C. 154(b) by 86 days.

(21) Appl. No.: 11/184,389

(22) Filed: Jul. 19, 2005

(65) Prior Publication Data

US 2007/0017096 A1 Jan. 25, 2007

(51) Int. Cl.
*A45D 29/02* (2006.01)
*B26B 17/00* (2006.01)

(52) U.S. Cl. ..... 30/28; 132/75.5

(58) Field of Classification Search ..... 30/26–28; 132/75.5, 75.4; D28/60
See application file for complete search history.

(56) References Cited

U.S. PATENT DOCUMENTS

| | | | | | |
|---|---|---|---|---|---|
| 741,709 | A * | 10/1903 | Petrelli | 30/28 |
| 767,423 | A * | 8/1904 | Nicholls | 30/28 |
| 846,924 | A * | 3/1907 | Kampfe | 132/75.5 |
| 898,808 | A * | 9/1908 | Wilcox | 132/75.5 |
| 1,841,847 | A * | 1/1932 | Peters | 30/28 |
| 2,515,852 | A * | 7/1950 | Bilsky | 30/28 |
| 2,739,379 | A * | 3/1956 | Bassett | 30/28 |
| 3,744,131 | A * | 7/1973 | Manes | 30/28 |
| 4,196,514 | A * | 4/1980 | Merriman | 30/28 |
| 4,380,120 | A * | 4/1983 | Hannon | 30/28 |
| 4,614,031 | A * | 9/1986 | Chen | 30/28 |
| 4,644,644 | A * | 2/1987 | Elsholz | 30/28 |
| 4,776,090 | A * | 10/1988 | Grassi | 30/28 |
| 5,187,869 | A * | 2/1993 | Heiss | 30/189 |
| 5,384,960 | A * | 1/1995 | Tottenham | 30/28 |
| 5,392,518 | A * | 2/1995 | Means | 30/28 |
| 5,524,344 | A * | 6/1996 | Bazal | 30/28 |
| 5,537,747 | A * | 7/1996 | Cacciotti et al. | 132/75.5 |
| 5,704,125 | A * | 1/1998 | Lee | 30/28 |
| 2003/0010349 | A1 * | 1/2003 | Rende | 30/28 |
| 2005/0160604 | A1 * | 7/2005 | Di Bitonto et al. | 30/28 |

FOREIGN PATENT DOCUMENTS

| | | | |
|---|---|---|---|
| FR | 2792179 | A1 * | 10/2000 |
| JP | 02116308 | A * | 5/1990 |
| JP | 2005152549 | A * | 6/2005 |

* cited by examiner

*Primary Examiner*—Jason Daniel Prone
(74) *Attorney, Agent, or Firm*—Buckingham, Doolittle & Burroughs, LLP

(57) ABSTRACT

A toenail clipper is provided that includes a two cutting members. A cam is attached to one cutting member and a leverage arm is pivotally attached to the other cutting member. The leverage arm engages the cam to provide amplified force to cut various items like thickened toenails and fingernails. A handle is also included that is connected to the leverage arm. The handle includes non-slip gripping material to prevent slippage during use of the clippers.

12 Claims, 1 Drawing Sheet

TOENAIL CLIPPER

I. BACKGROUND OF THE INVENTION

A. Field of Invention

This invention pertains to the art of methods and apparatuses for cutting devices and, more specifically to a toenail clipper.

B. Brief History

The conventional toenail clipper contains a lever arm secured to the body of the clipper by a central peg. Typically, the peg is anchored to the base of the clipper. The lever arm may include an angled portion, usually triangular or elliptical in shape that protrudes from the lever arm. This angled portion creates a fixed point that gives the clipper its leverage. The upper and lower clipper bodies are connected at one end and open at the other end, with each having sharpened edges at the opened end. Cutting is commenced by depressing the lever arm using the angled portion of the lever arm as leverage. As this motion starts, the angled portion of the clipper pushes the clipper body down. Since the blades are held together at their tips by the peg, the top blade is allowed to move down along the peg as it is compressed by the work of the lever arm. As such, the upper blade moves down until it contacts the bottom blade, thus cutting a fingernail or toenail that is placed between them.

This conventional nail clipper design is typically not well suited for cutting thickened toenails. The user often has to put an extra amount of effort into cutting these nails with the conventional nail clippers, and at times does not succeed. The simple leverage system of the existing clipper does not create enough force to easily cut the nail. Therefore, it would be beneficial to have a nail clipper that reduces the amount of force needed to cut thickened toenails. Additionally, it would be helpful to have a nail clipper that minimizes the slip occurring at the lever arm during the toenail cutting process. The subject invention solves the aforementioned problem.

II. SUMMARY OF THE INVENTION

One aspect of the subject invention includes a cutting clipper that includes a first cutting member having first and seconds ends, the first cutting member having a cutting edge at the first end of the first cutting member; a second cutting member having first and second ends, the second cutting member having a cutting edge at the first end of the second cutting member, wherein the second end of the first cutting member is fixedly connected to the second end of the second cutting member; a cam fixedly connected to the first cutting member; and, a lever arm pivotally connected with respect to the second cutting member for use in engaging the cam to juxtapose the cutting edge of the first cutting member to the cutting edge of the second cutting member.

Another aspect of the subject invention includes a cutting clipper wherein the first end of the first cutting member is selectively moveable with respect to the first end of the second member between a first spaced apart position and a second juxtaposed position.

Yet another aspect of the subject invention includes a cutting clipper wherein the lever arm includes a first lever arm portion and a second lever arm portion, the second lever arm portion extending from the first lever arm portion at an angle, and, further including a roller member rotatably connected with respect to the lever arm, the roller member connected between the lever arm and the cam.

Still yet another aspect of the subject invention includes a cutting clipper wherein the first lever arm member has a length L1, wherein the second lever arm member has a length L2, and, wherein L2 is longer than L1.

Even yet another aspect of the subject invention includes a cutting clipper wherein the ratio of L2/L1 ranges from 1.5 to 4.

Yet another aspect of the subject invention includes a cutting clipper wherein the roller member is rotatably connected with respect to the second lever arm portion, and, further including a handle pivotally connected with respect to the second cutting member, the handle being rotatably connected with respect to the first lever arm portion.

Still another aspect of the subject invention includes a cutting clipper having first and second gripping pads, the first gripping pad affixed to the second cutting member, the second gripping pad affixed to the handle.

Yet another aspect of the subject invention includes a cutting clipper having at least a first post rigidly extended from the second cutting member, and, wherein the lever arm is pivotally connected to the at least a first post for use in engaging the cam to juxtapose the cutting edge of the first cutting member to the cutting edge of the second cutting member.

Still another aspect of the subject invention includes a cutting clipper having at least a second post rigidly extended from the second cutting member, and, wherein the handle is pivotally connected to the at least a second post.

A toenail clipper is discussed herein that increases leverage and grip when cutting toenails. The toenail clipper is comprised of upper and lower members of the clipper body, a lever arm, four support members, and angled body, a roller, and a roller ramp. The upper and lower members of the clipper body may be connected at one end while the distal end has an open space containing the cutting edges. The lever arm may have two ends: one padded with a grip type surface, and the other affixed to the angled body by a pin, which creates a continuous hinge. The lever arm has a fixed point where it meets the support member creating a fixed hinge. This fixed point may be located anywhere on the lever arm, but in one embodiment has the fixed point near the continuous hinge. Both ends of the lever arm rotate around this fixed point. The four support members, two small and two large, may be appropriately positioned to create pivot points where the body is attached and rotates thereabout. The two smaller support members connect the lever arm to the clipper body creating a hinge. This hinge allows the end of the lever arm opposite the grip surface to rise upon the depression of the lever arm. The large support members may be positioned to create a pivot point for the angled body and secure the angled body to the clipper body. The angled body can include any angle between 0 degrees and 180 degrees. In one embodiment, the angle is 90 degrees. Support members may be affixed to the angled body at the point of intersection of its two sides. The first end of the angled body is affixed to the lever arm by a pin creating the fore mentioned continuous joint. The second end is affixed to the roller. The roller is secured on either end to the angled member and moves with the motion of the angled body. As the lever arm is depressed, the continuous hinge raises, causing the angled body to rotate around the fixed hinge. As the roller moves up the roller ramp, the sharpened opening of the clipper closes.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
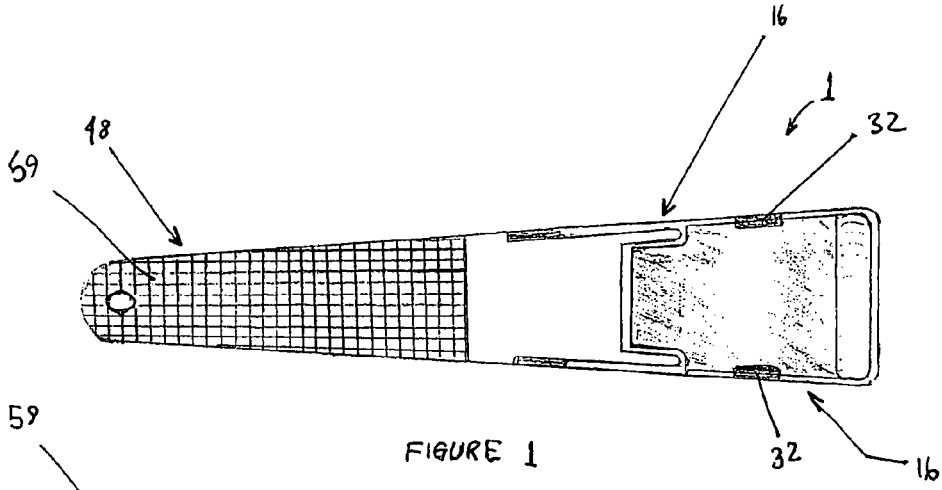
FIG. 1 is a top view showing the toenail clipper.
Figure 2:
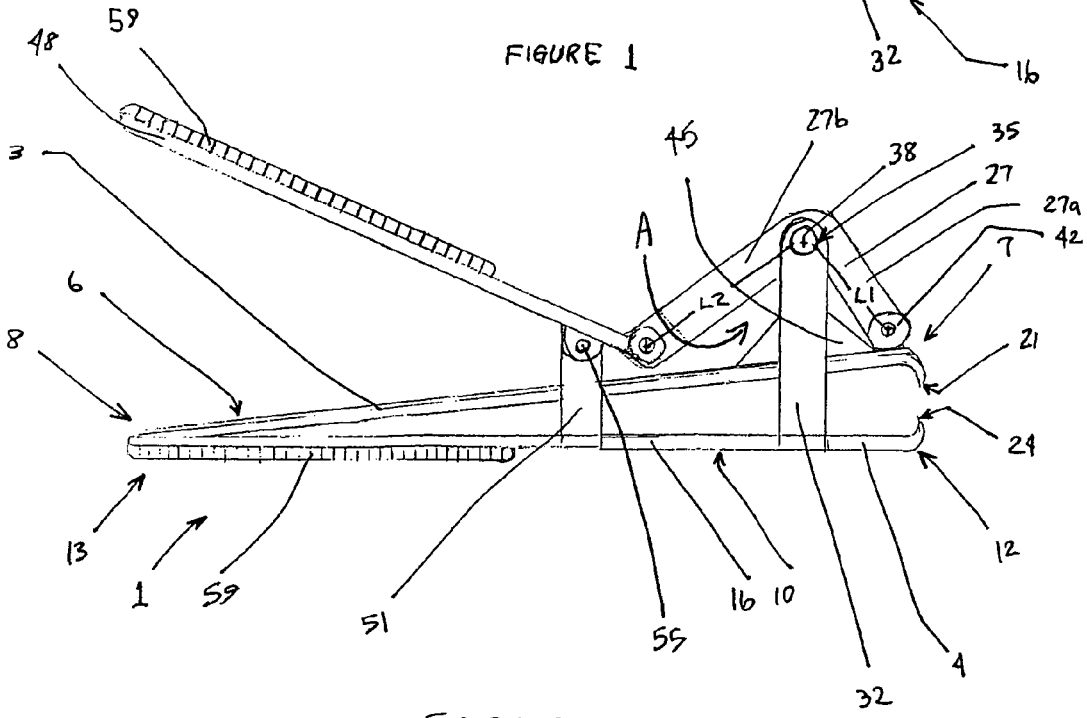
FIG. 2 is a side view of the entire nail clipper showing the handle, cutting members, lever arm, roller, and cam.

Referring now to the drawings wherein the showings are for purposes of illustrating a preferred embodiment of the invention only and not for purposes of limiting the same, FIGS. 1 and 2 depict a clipper shown generally at 1. The clipper 1 may include first 3 and second 4 a cutting members. The first and second cutting members 3, 4 may be generally longitudinal each having a substantially planar configuration. This allows the cutting members 3, 4 to be placed one on top of the other for assembly purposes as will be discussed further in the paragraphs below. The first cutting member 3 may be described as having a top portion and first and second ends 7, 8 respectively. in a similar manner, the second cutting member 4 may have bottom portion 10 and first and second ends shown at 12 and 13 respectively. The first and second cutting members 3, 4 may further include side portions 16 from which support members extend as will be discussed further in a subsequent paragraph. The clipper 1 may include an upper cutting edge 21 fashioned on the first end 7 of the first cutting member 3 and a fixed lower cutting edge 24 similarly fashioned on the first end 12 of the second cutting member 4. As the first ends 7, 12 of the cutting members 3, 4 are brought together the cutting edges 21, 24 may be used to cut toenails, fingernails or any other item as is appropriate for the subject invention. The cutting members 3, 4 may be constructed from a sufficiently hard material so that the cutting members 3, 4 may efficiently cut the items as desired. The cutting, members 3, 4 may be constructed a metal or other material as is appropriate for cutting the items described above. It is noted here that metal retains its shape if it is bent to a small degree. in other words, metal is elastically deformable.

With continued reference to FIGS. 1 and 2, the clippers 1 may additionally include a lever arm 27 pivotally connected to posts or support members 32. The support members 32 may extend from a side 16 of the second cutting member upward past the top portion 6 of the first cutting member 3. The support members 32 may be rigidly secured to the second cutting member for use in supporting the lever arm 27 as it moves during operations of the clipper 1. The distal end of the support members 32 may include a hole 35 fashioned therein for use in receiving a pin 38. The pin 38 may be inserted through the holes 35 and through the lever arm 27 creating a pivot point about which the lever arm 27 moves. Any manner of connecting the lever arm 27 and the pin 38 for pivotal rotation to the support members 32 may be chosen with sound engineering In one embodiment, the lever arm 27 may comprise two lever arm portions 27*a*, 27*b*. The first arm portion 27*a* may be configured at an angle A with respect to the second arm portion 27*b*. In this embodiment the angle A may be 90° . However, the angle A may fall within the range of 0° to 180°. The arm portions 27*a* , 27*b* may also have different arm portion segment lengths, Arm portion 27*a* may have a length L1 and arm portion 27*b* may have a length L2. The ratio of L2/L1 may fall within the range 1 to 8 . More preferably. the ratio L2/L1 is with the range 1.5 to 4. However, any ratio of L2/L1 may be chosen with sound engineering judgment as is appropriate for use with the subject invention. It is noted here that the longer arm portion L2, over L1, provides increased leverage and torque that may be used to cut thicker nails or harder substances more easily.

With continued reference to FIGS. 1 and 2, a roller 42 may rotatably connected to the end of the leverage arm 27. More specifically, the roller 42 may be connected to the end of the arm portion 27*a*. Any manner of rotatably securing the roller 42 to the leverage arm 27 may be chosen with sound engineering judgment. The leverage arm 27 and the roller 42 may be positioned proximate to a cam or cam member 45. The cam member 45 may be fixedly attached to the top portion 6 of the cutting member 3. In one embodiment, the cam member 45 may include a linear sloped cam surface designed to be in contact with the roller 42. Alternatively, the cam may be curved or include any configuration as is appropriate for use with the subject invention. In this manner, when the leverage arm 27 is pivoted the roller 42 moves up the cam surface thereby creating a force that pushes the first cutting member 3 downward with respect to the second cutting member 4. As the support arms 32 are fixed to the second cutting member 4, force from the pivoting leverage arm 27 brings the cutting edge 21 into a cutting relationship with cutting edge 24. It is noted here that the second ends 8, 13 of the cutting members 3, may be fixedly connected together. More specifically, the cutting members 3, 4 may be riveted together at their respective ends 8, 13. However, any manner of securing the cutting members 3, 4 together may be chosen with sound engineering judgment. In the securing the cutting members 3, 4 together, the second ends 8, 13 of the cutting member 3, 4 may be juxtaposed to each other while the first ends 7, 12 may be spaced apart so that the item being cut may be placed in between the cutting edges 21, 24. In this way, the cutting members 3, 4 may be elastically deformable so that when the force from the leverage arm 27 and the cam 45 force the first cutting member 3 downward with respect to the second cutting member 4, the first cutting 3 member may spring back into its original spaced apart position when the force from the leverage 27 is released.

With continued reference to FIGS. 1 and 2, a handle 48 may be hingingly connected to the leverage arm 27. The handle 48 may be pivotally connected to a second set of support arms 51 via a pin 55 or other pivoting mechanism. One end of the handle 48 may be rotatably connected to the leverage arm 27 at the distal end of the arm 27 with respect to the roller 42. The configuration of the leverage arm 27 and the handle 48 are constructed so that in the open position, the handle 48 is extended upward from the top surface 6 of the first cutting member 3. In this manner, when the operator depresses the handle 48 against the second cutting member 4, force is applied through the handle 48, via the leverage arm 27 and transferred to the cutting edges 21, 24. In certain circumstances, the handle 48 and the top portion 10 of the second cutting member 4 may become slippery before and/or during use. The handle 48 and second cutting member 4 may therefore be covered with gripping pads 59 or gripping material 59. The material 59 may be secured to the surfaces via adhesives. However, any manner of securing the gripping material to the handle 48 and/or the second cutting member 4 may be chosen with sound engineering judgment. In one embodiment, the gripping material 59 may be a polymeric material. The gripping material 59 may be textured to allow for no-slip gripping action during use. The gripping material 59 may also be soft for easy gripping action during use. However, any type of gripping material may be chosen as is appropriate for use with the subject invention.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof. Having thus described the invention, it is now claimed:

I claim:

1. A cutting clipper, comprising:

a first cutting member having first and seconds ends, the first cutting member having a cutting edge at the first end;

a second cutting member having first and second ends, the second cutting member having a cutting edge at the first end, wherein the second end of the first cutting member is fixedly connected to the second end of the second cutting member;

a cam fixedly connected to the first cutting member; and, at least a first post extending from the second cutting member; at least a second post extending from the second cutting member; a lever arm for engaging the cam to juxtapose the cutting edge of the first cutting member to the cutting edge of the second cutting member; the lever arm being pivotally connected to the at least a first post at a first pivot point; and a handle pivotally connected to the at least a second post at a second pivot point and being pivotally connected to the lever arm at a third pivot point.

a handle operatively pivotally connected to the lever arm.

2. The cutting clipper of claim 1, wherein the first and second cutting members are constructed from an elastically deformable material.

3. The cutting clipper of claim 2, wherein the first end of the first cutting member is selectively moveable with respect to the first end of the second cutting member between a first spaced apart position and a second juxtaposed position.

4. The cutting clipper of claim 3, wherein the lever arm includes a first lever arm portion and a second lever arm portion, the second lever arm portion extending from the first lever arm portion at an angle, and, further comprising:

a roller member rotatably connected with respect to the lever arm, the roller member operatively connected between the lever arm and the cam.

5. The cutting clipper of claim 4, wherein the first lever arm portion has a second length, wherein the second lever arm portion has a first length, and, wherein a second length is longer than a first length.

6. The cutting clipper of claim 5, wherein the ratio of the second length/the first length ranges from 1.5 to 4.

7. The cutting clipper of claim 1, wherein the handle is pivotally connected to the at least a second post via a pin.

8. The cutting clipper of claim 1, wherein the lever arm includes a first lever arm portion and a second lever arm portion, the second lever arm portion extending from the first lever arm portion at a 90° angle.

9. The cutting clipper of claim 1, wherein the lever arm is pivotally connected to the at least a first post via a pin.

10. A cutting clipper, comprising:

a first cutting member having first and seconds ends, the first cutting member having a cutting edge at the first end;

a second cutting member having first and second ends, the second cutting member having a cutting edge at the first end, wherein the second end of the first cutting member is fixedly connected to the second end of the second cutting member;

a cam fixedly connected to the first cutting member; and, at least a first post extending from the second cutting member; at least a second post extending from the second cutting member; a lever arm for engaging the cam to juxtapose the cutting edge of the first cutting member to the cutting edge of the second cutting member; wherein the lever arm is pivotally connected to the at least a first post at a first pivot point;

wherein the first and second cutting members are constructed from an elastically deformable material;

wherein the first end of the first cutting member is selectively moveable with respect to the first end of the second cutting member between a first spaced apart position and a second juxtaposed position;

wherein the lever arm includes a first lever arm portion and a second lever arm portion, the second lever arm portion extending from the first lever arm portion at an angle, and, further comprising:

a roller member rotatably connected with respect to the lever arm, the roller member operatively connected between the lever arm and the cam;

wherein the first lever arm portion has a second length, wherein the second lever arm portion has a first length, and, wherein a second length is longer than a first length;

wherein the ratio of the second length/the first length ranges from 1.5 to 4;

wherein the roller member is rotatably connected with respect to the second lever arm portion, and, further comprising:

a handle pivotally connected to the at least second post at a second pivot point and is pivotally connected to the first arm portion at a third pivot point.

11. The cutting clipper of claim 10, further comprising:

at least a first gripping pad, the at least first gripping pad affixed to at least one of the second cutting member and the handle.

12. A cutting clipper, comprising:

a first cutting member having first and seconds ends, the first cutting member having a cutting edge at the first end;

a second cutting member having first and second ends, the second cutting member having a cutting edge at the first end, wherein the second end of the first cutting member is fixedly connected to the second end of the second cutting member;

a cam fixedly connected to the first cutting member; and, at least a first post extending from the second cutting member; at least a second post extending from the second cutting member; a lever arm for engaging the cam to juxtapose the cutting edge of the first cutting member to the cutting edge of the second cutting member; wherein the lever arm is pivotally connected to the at least a first post at a first pivot point;

wherein the first and second cutting members are constructed from an elastically deformable material;

wherein the first end of the first cutting member is selectively moveable with respect to the first end of the second cutting member between a first spaced apart position and a second juxtaposed position;

wherein the lever arm includes a first lever arm portion and a second lever arm portion, the second lever arm portion extending from the first lever arm portion at an angle, and, further comprising:

a roller member rotatably connected with respect to the lever arm, the roller member operatively connected between the lever arm and the cam;

wherein the first lever arm portion has a second length, wherein the second lever arm portion has a first length, and, wherein a second length is longer than a first length;

wherein the ratio of the second length/the first length ranges from 1 to 8;

wherein the roller member is rotatably connected with respect to the second lever arm portion, and, further comprising:

a handle pivotally connected to the at least second post at a second pivot point and is pivotally connected to the first arm portion at a third pivot point.

* * * * *